United States Patent [19]

Kikuchi et al.

[11] 4,361,320

[45] Nov. 30, 1982

[54] SHEET DISTRIBUTION METHOD AND APPARATUS

[75] Inventors: Hideo Kikuchi; Tamaki Kaneko, both of Tokyo, Japan

[73] Assignee: Ricoh Company, Ltd., Tokyo, Japan

[21] Appl. No.: 102,507

[22] Filed: Dec. 11, 1979

[30] Foreign Application Priority Data

| | | | |
|---|---|---|---|
| Dec. 21, 1978 | [JP] | Japan | 53-156892 |
| Dec. 28, 1978 | [JP] | Japan | 53-160980 |
| Dec. 28, 1978 | [JP] | Japan | 53-160981 |

[51] Int. Cl.[3] ..... B65H 39/11; B65H 43/02

[52] U.S. Cl. ..... 271/288; 271/259; 271/290; 271/296

[58] Field of Search ..... 271/288, 289, 290, 287, 271/296, 297, 298, 258, 259

[56] References Cited

U.S. PATENT DOCUMENTS

| | | | |
|---|---|---|---|
| 3,709,485 | 1/1973 | Acquaviva | 271/290 X |
| 3,830,590 | 8/1974 | Harris et al. | 271/290 X |
| 4,200,278 | 4/1980 | Ginori | 271/296 |
| 4,212,457 | 7/1980 | Guenther | 271/288 |

*Primary Examiner*—Bruce H. Stoner, Jr.
*Attorney, Agent, or Firm*—David G. Alexander

[57] ABSTRACT

A plurality of bins (31) to (40) are divided into two groups which are used alternatingly when a number of copies N to be collated exceeds the number of bins, thus allowing a copying machine to operate continually and further allowing an operator to remove the collated copies from one group while the copies are being collated in the other group. When the number of pages P of a document exceeds a predetermined number, the first group is defined to contain more bins than the second group, thereby reducing the number of times each page must be fed to the copying machine. A unique sensor arrangement (151) senses for feed failures using only two sensors (78), (79).

26 Claims, 15 Drawing Figures

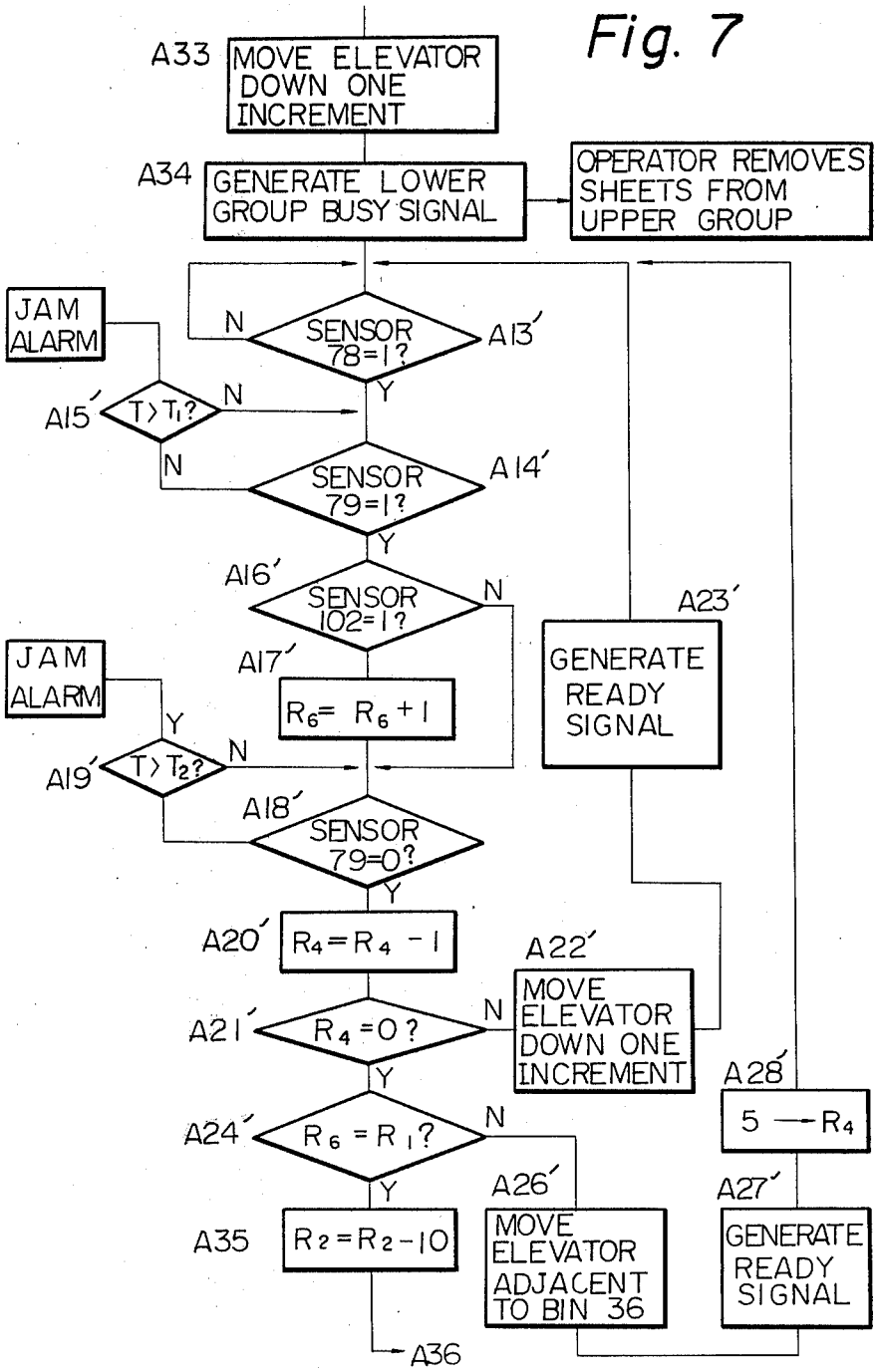
Fig. 7
A33
MOVE ELEVATOR DOWN ONE INCREMENT
A34
GENERATE LOWER GROUP BUSY SIGNAL
OPERATOR REMOVES SHEETS FROM UPPER GROUP
JAM ALARM
N
SENSOR 78=1?
A13'
Y
A15'
T>T1?
N
N
SENSOR 79=1?
A14'
Y
A16'
SENSOR 102=1?
N
A23'
GENERATE READY SIGNAL
JAM ALARM
A17'
R6= R6 + 1
Y
A19'
T>T2?
N
A18'
SENSOR 79=0?
Y
A20'
R4=R4 - 1
A22'
MOVE ELEVATOR DOWN ONE INCREMENT
A21'
R4 =0?
N
Y
A28'
5 — R4
A24'
R6 = R1?
N
Y
A26'
MOVE ELEVATOR ADJACENT TO BIN 36
A27'
GENERATE READY SIGNAL
A35
R2=R2-10
A36

AA
B15
GENERATE START SIGNAL
B16
SENSOR 78=1?
N
Y
JAM ALARM
Y
B18
T>T1?
B17
SENSOR 79=1?
N
JAM ALARM
Y
B20
T≥T2?
B19
SENSOR 79=0?
N
Y
B24
GENERATE READY SIGNAL
B21
R3=R3-1
B23
MOVE ELEVATOR DOWN ONE INCREMENT
B22
R3=0?
N
B30
N.5 OR 7 → R3
B25
R5=R5+1
B26
R5=R1?
N
Y
B31
R4=0?
N
Y
END
B32
B27
ELEVATOR ADJACENT TO BIN 31?
N
B28
MOVE ELEVATOR DOWN ONE INCREMENT
B29
Y
GENERATE READY SIGNAL
B33
SHEETS IN LOWER GROUP?
N
B35
B36
Y
GENERATE BUSY SIGNAL
B33

B35
MOVE ELEVATOR DOWN ONE INCREMENT
B36
GENERATE LOWER GROUP BUSY SIGNAL
OPERATOR REMOVES SHEETS FROM LOWER GROUP
SENSOR 78=1?
B16'
N
Y
JAM ALARM
T>T1?
B18'
SENSOR 79=1?
B17'
JAM ALARM
T>T2?
B20'
B24
GENERATE READY SIGNAL
SENSOR 79=0?
B19'
B21'
R4=R4-1
B23'
MOVE ELEVATOR DOWN ONE INCREMENT
B22'
R4=0?
B25'
R6=R6+1
MOVE ELEVATOR UP ONE INCREMENT
B28'
B26'
R6=R1?
B37
R2=R2-10
B38
B27'
R-1 INCREMENTS ?
B29'
GENERATE READY SIGNAL
B30'
5 OR 3 → R4

SHEET DISTRIBUTION METHOD AND APPARATUS

BACKGROUND OF THE INVENTION

The present invention relates to a sheet distribution method and apparatus for performing sheet distribution operations such as collating and sorting.

Collating and sorting operations may be performed using a plurality of bins or trays and means for distributing sheets into the bins. In collation, one copy of each page of a manuscript is distributed into each bin to provide complete copies of the manuscript. In sorting, a plurality of copies of each page are distributed into the respective bins to sort the copies by pages.

It is often desired to perform a distribution operation such as collating or sorting which exceeds the number of bins. For example, where the apparatus comprises 20 bins it may be desired to collate 35 copies. One method of overcoming the problem is to collate 20 copies, remove the copies from the bins and then collate 15 more copies. However, this is undesirable in that the copying operation must be interrupted long enough for the operator to remove the first twenty collated copies from the bins. Another expedient is to provide another collating apparatus in series with the first apparatus. Although this increases the capacity of the system, it also increases the cost and the number of places in the sheet feed path where sheets can jam.

Another problem is how to sense for a jam or other sheet feed failure. Prior art apparatus comprise a separate sensor for each bin and electronic circuitry for scanning the outputs of the sensors. This arrangement is unnecessarily expensive and complex.

SUMMARY OF THE INVENTION

A sheet distribution method for distributing a plurality of sets of sheets into separate bins, comprises the steps of providing a predetermined number of bins and distribution means for selectively distributing the sheets to the bins, computing whether a number of the sets of sheets is greater than the number of bins, and when the number of sets of sheets is greater than the number of bins, dividing the bins into first and second groups, distributing sets of sheets into the first group of bins and then distributing sets of sheets into the second group of bins.

A sheet distribution apparatus embodying the present invention includes a plurality of bins and distribution means for selectively distributing sheets into the bins, and is characterized by comprising first sensor means for sensing presence of a sheet at an inlet of the distribution means, second sensor means for sensing presence of the sheet at an outlet of the distribution means, and timing means responsive to the first and second sensor means for generating an alarm at a first predetermined time after the first sensor means senses the presence of the sheet unless the second sensor means senses presence of the sheet within the first predetermined time. The first and second sensor means are constructed to produce first and second signals respectively in response to sensing of a leading edge of the sheet, the timing means generating the alarm unless the second signal is generated within the first predetermined time after the first signal is generated. The second sensor means is further constructed to produce a third signal in response to sensing a trailing edge of the sheet, the timing means being further constructed to generate the alarm unless the third signal is generated within a second predetermined time after the second signal is generated. The distribution means comprises a fixed inlet means and a movable outlet means which is movable relative to the bins, the first and second sensor means being disposed adjacent to the inlet and outlet means respectively. The timing means is responsive to a position of the outlet means and constructed to compute the first predetermined time as a function thereof, the first predetermined time being slightly greater than a time required for the leading edge of the sheet to be fed from the first sensor means to the second sensor means.

In accordance with the present invention, a plurality of bins are divided into two groups which are used alternatingly when a number of copies to be collated exceeds the number of bins, thus allowing a copying machine to operate continuously and further allowing an operator to remove the collated copies from one group while the copies are being collated in the other group. When the number of pages of a document exceeds a predetermined number, the first group is defined to contain more bins than the second group, thereby reducing the number of times each page must be fed to the copying machine. A unique sensor arrangement senses for feed failures using only two sensors.

It is an object of the present invention to provide an improved sheet distribution method which is capable of collating or sorting an unlimited number of copies using a small number of bins without interrupting the operation of an associated copying machine or printing machine.

It is another object of the present invention to provide a sheet distribution apparatus comprising improved means for sensing a sheet jam or other failure using only two sensors and simple associated circuitry.

It is another object of the present invention to provide a generally improved sheet distribution method and apparatus.

Other objects, together with the foregoing, are attained in the embodiments described in the following description and illustrated in the accompanying drawing.

BRIEF DESCRIPTION OF THE DRAWING

FIGS. 5, 6, 7 and 8 in combination constitute a flowchart of the apparatus;

DESCRIPTION OF THE PREFERRED EMBODIMENTS

While the sheet distribution apparatus of the present invention is susceptible of numerous physical embodiments, depending upon the environment and requirements of use, substantial numbers of the herein shown and described embodiments have been made, tested and used, and all have performed in an eminently satisfactory manner.

Figure 1:
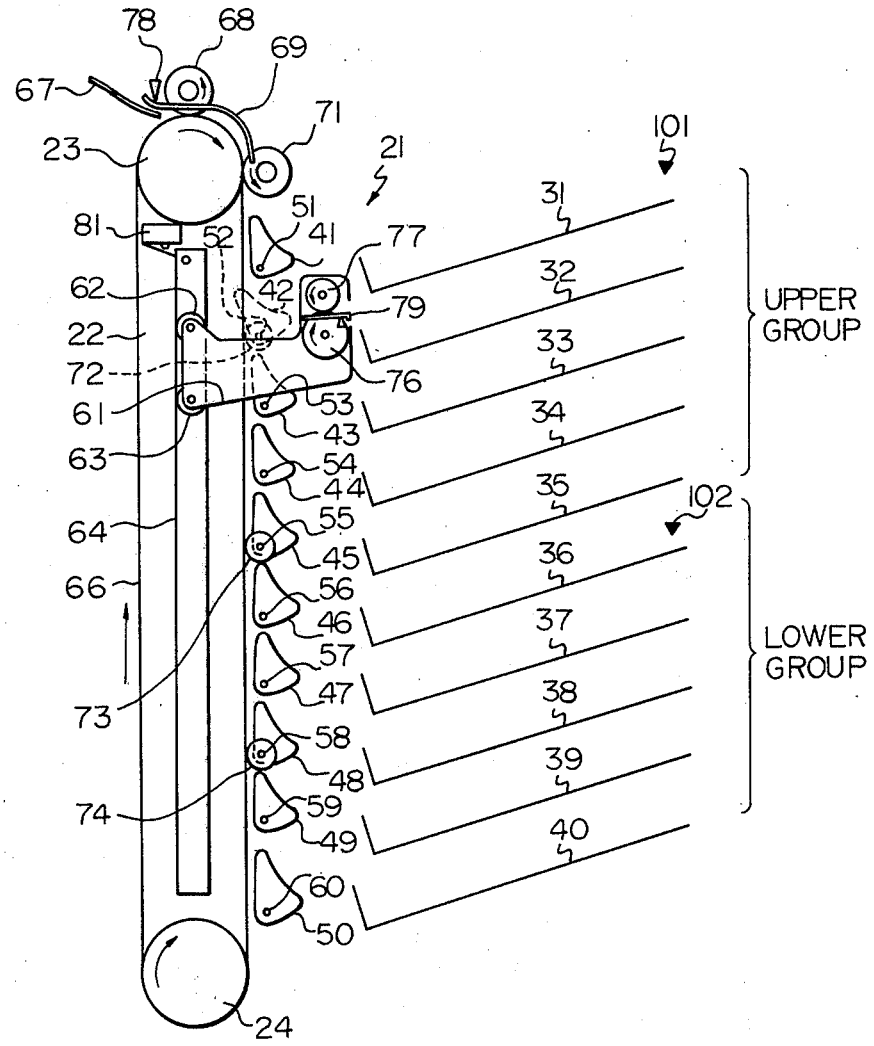
FIG. 1 is a schematic diagram of a sheet distribution apparatus embodying the present invention.

Referring now to FIG. 1 of the drawing, a sheet distribution apparatus embodying the present invention is generally designated by the reference numeral 21 and comprises an endless belt 22 trained around rollers 23 and 24. The roller 24 is continuously rotated clockwise at constant speed so that the belt 22 and roller 23 rotate therewith.

A plurality of trays or bins 31 to 40 are vertically arranged in front of the belt 22. Deflector pawls 41 to 50 are pivotally mounted on shafts 51 to 60 respectively and normally assume inoperative positions spaced away from the belt 22.

An elevator 61 is supported for vertical movement by means of rollers 62 and 63 which ride in a slot 64 formed in a frame 66 which rotatably supports the rollers 23 and 24. A sheet 67 which is to be fed into one of the bins 31 to 40 from a copying machine, printing machine or the like (not shown) is fed into a bite between the roller 23 and an idler roller 68 which engages with the roller 23. A guide 69 guides the sheet 67 between the bite of the roller 23 and another idler roller 71 which feeds the sheet 67 downwardly along with the belt 22. Feeding of the sheet 67 is ensured by means of idler rollers 72, 73 and 74 which are rotatably mounted on the shafts 52, 55 and 58 respectively and press against the belt 22. The distances between the adjacent rollers 68, 71, 72, 73 and 74 are smaller than the length of the sheet 67 to ensure feeding.

The elevator 61 is provided with means which will be described below to actuate the pawl 41 to 50 corresponding to the bin 31 to 40 to which the elevator 61 is adjacent. As illustrated, the elevator 61 is adjacent to the bin 32 and the pawl 42 is moved to the operative position to deflect the sheet 67 into the tray 32. If desired, the belt 22 may be formed with a slit through which the pawls 41 to 50 extend. At any rate, actuation of one of the pawls 41 to 50 by the elevator 61 to the operative position causes the sheet 67 to be deflected into the corresponding bin 31 to 40 respectively.

A roller 76 is rotated clockwise at constant speed and cooperates with an idler roller 77 to feed the sheet 67 from the elevator 61 into one of the bins 31 to 40. Further illustrated are an inlet sensor 78 provided upstream of the roller 68 and an outlet sensor 79 provided downstream of the roller 76 which may be photoelectric units, microswitches, etc. Another sensor in the form of a microswitch 81 is actuated when the elevator 61 is in an uppermost or home position adjacent to the bin 31.

Figure 2:
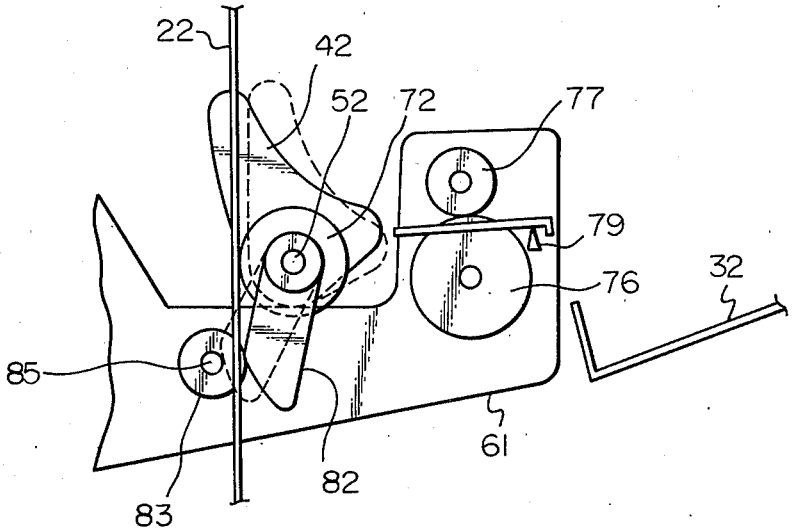
FIG. 2 is an enlarged view of part of the apparatus.

As shown in FIG. 2, each pawl 41 to 50 is provided with an arm, although only one arm 82 fixed to the pawl 42 is illustrated. A roller 83 is mounted on a pin 85 fixed to the elevator 61. When the roller 83 does not engage with the arm 82, the pawl 42 assumes the inoperative phantom line position. When the roller 83 does engage with the arm 82, the arm 82 and pawl 42 are rotated counterclockwise to the operative position shown in solid line.

Figure 3:
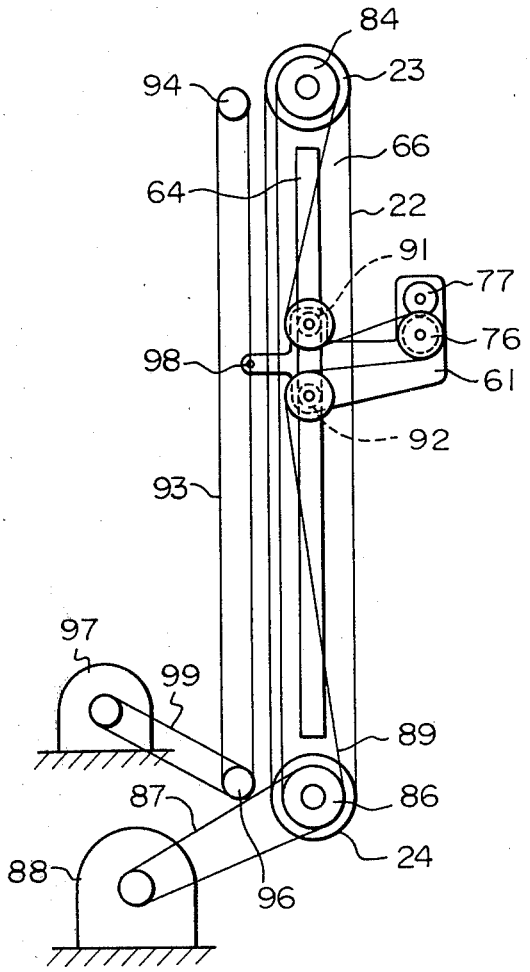
FIG. 3 is a simplified schematic view illustrating a drive system of the apparatus.

As shown in FIG. 3, pulleys 84 and 86 are mounted on the same shafts as the rollers 23 and 24 respectively. The pulley 86 is a double pulley which is rotated clockwise by means of a belt 87 driven by a motor 88. A belt 89 is trained around the pulley 86 and also the pulley 84. The pulley 86 is fixed to the roller 24 and causes rotation of the belt 22. The pulley 84 is rotated by the belt 89 separately from the roller 23. The belt 89 is also trained around the roller 76 or a pulley fixed thereto and guide pulleys 91 and 92. In this manner, the belt 22 and roller 76 are driven continuously from the motor 88.

Another belt 93 is trained around pulleys 94 and 96. The pulley 96 is a double pulley which is drivable from a motor 97 via a belt 99. The belt 93 is attached to the elevator 61 as indicated at 98.

The motor 97 is a stepping motor controlled to move the elevator 61 by unit distances from one bin 31 to 40 to another. Clockwise rotation of the belt 93 causes the elevator 61 to move downwardly and vice-versa.

Further illustrated in FIG. 1 are sensors 101 and 102 which sense for the presence of sheets in the bins 31 and 36 respectively. Although only ten bins are illustrated, any number of bins may be provided such as twenty.

Figure 4:
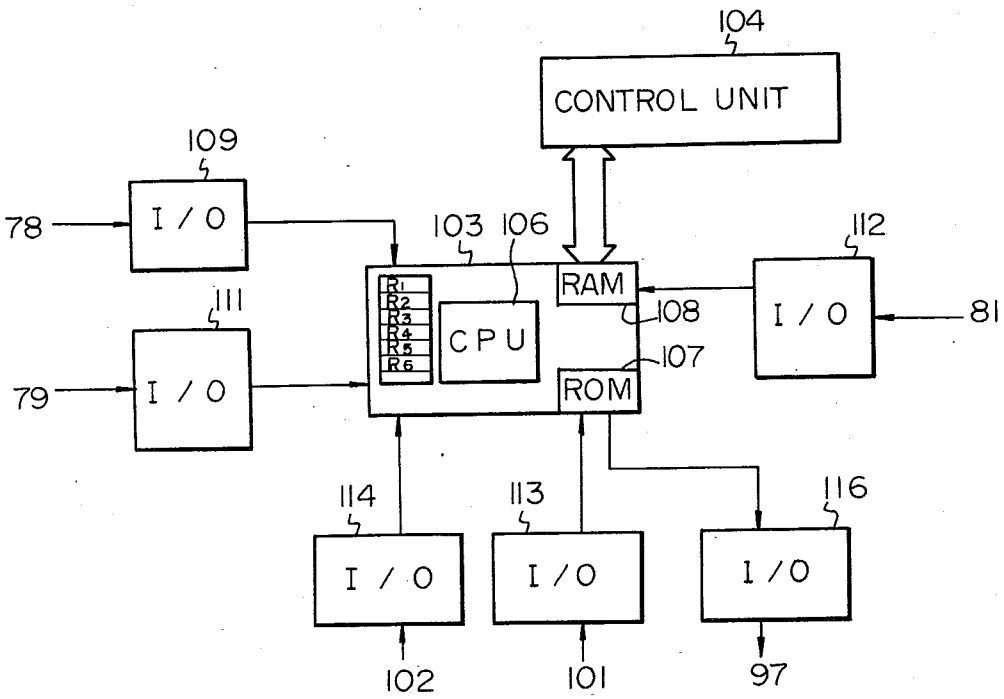
FIG. 4 is a block diagram of a computing and control system of the apparatus.
Figure 5:
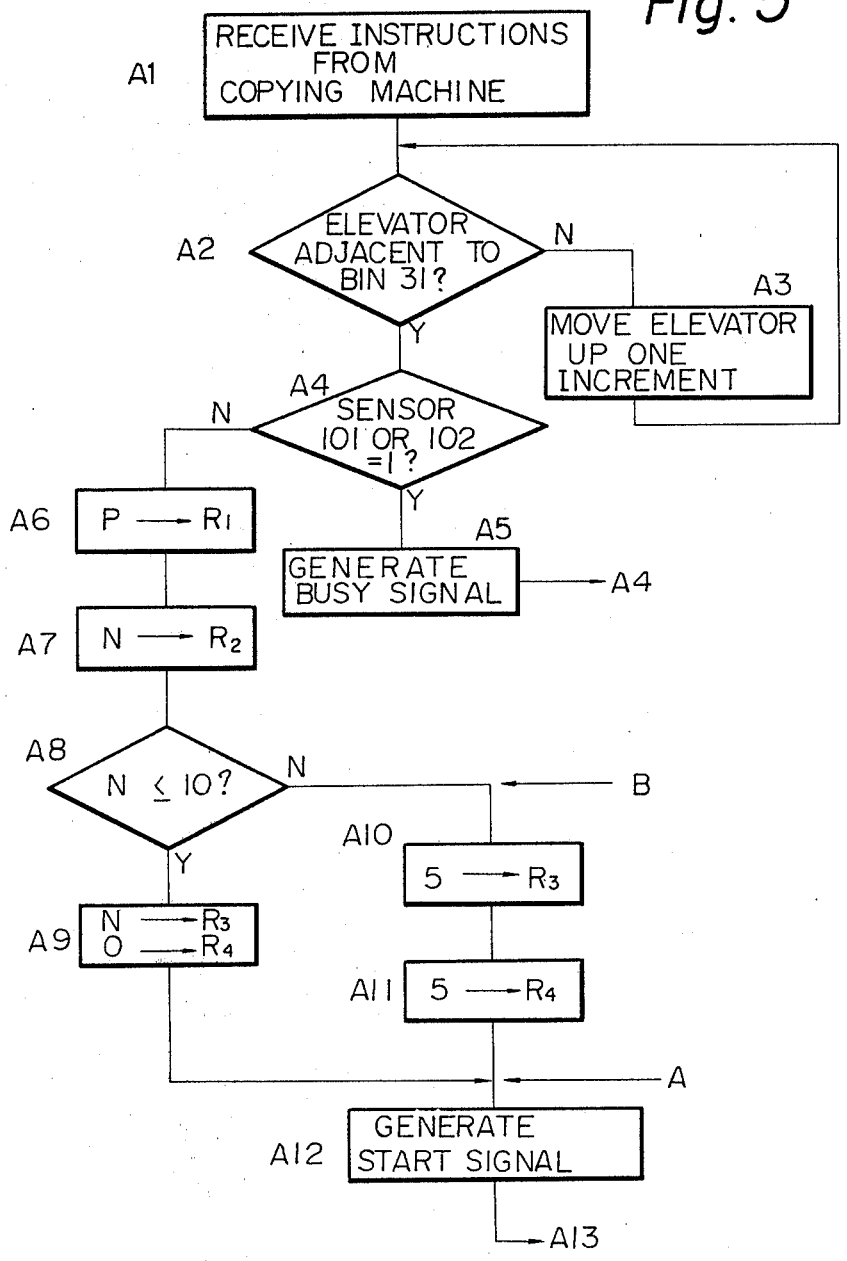
Figure 6:
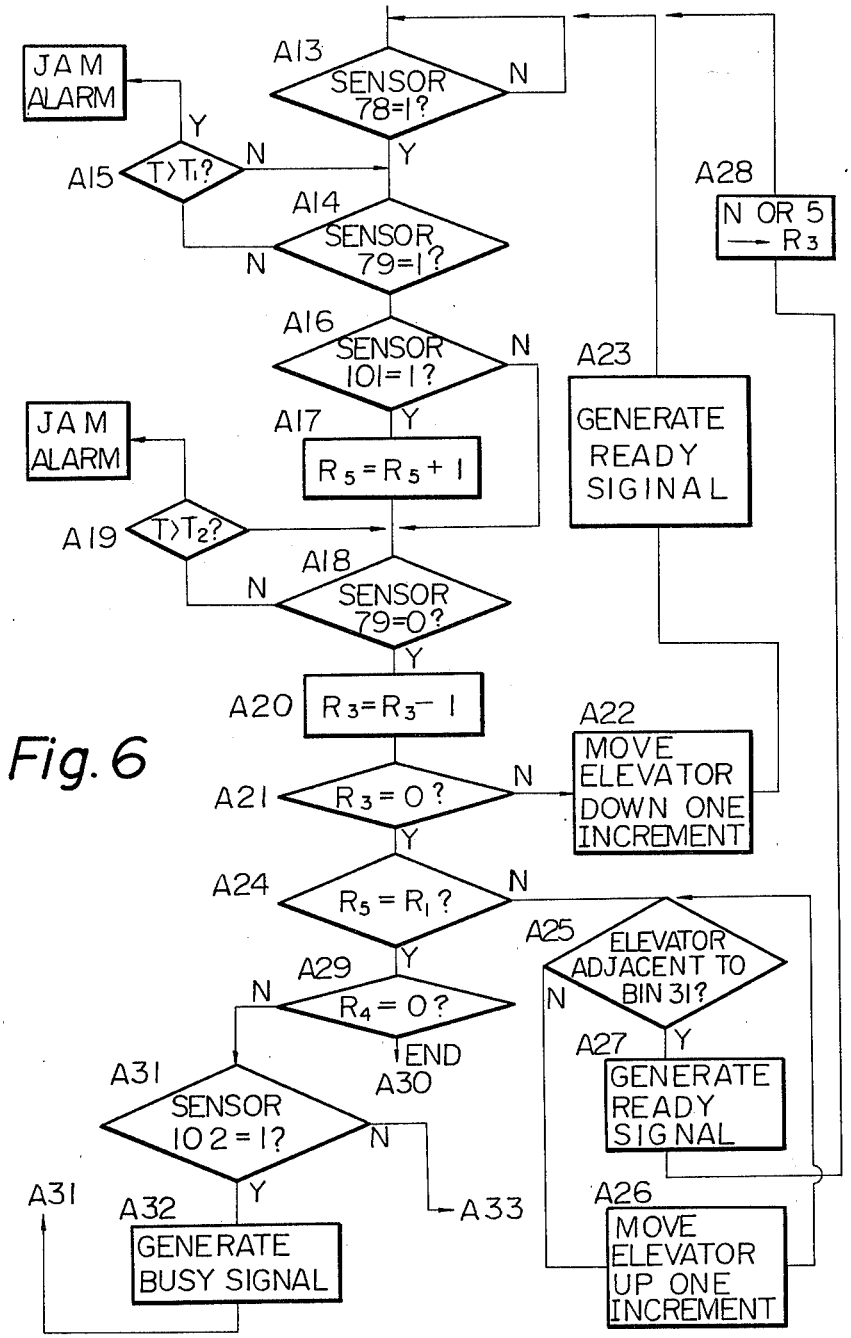
Figure 8:
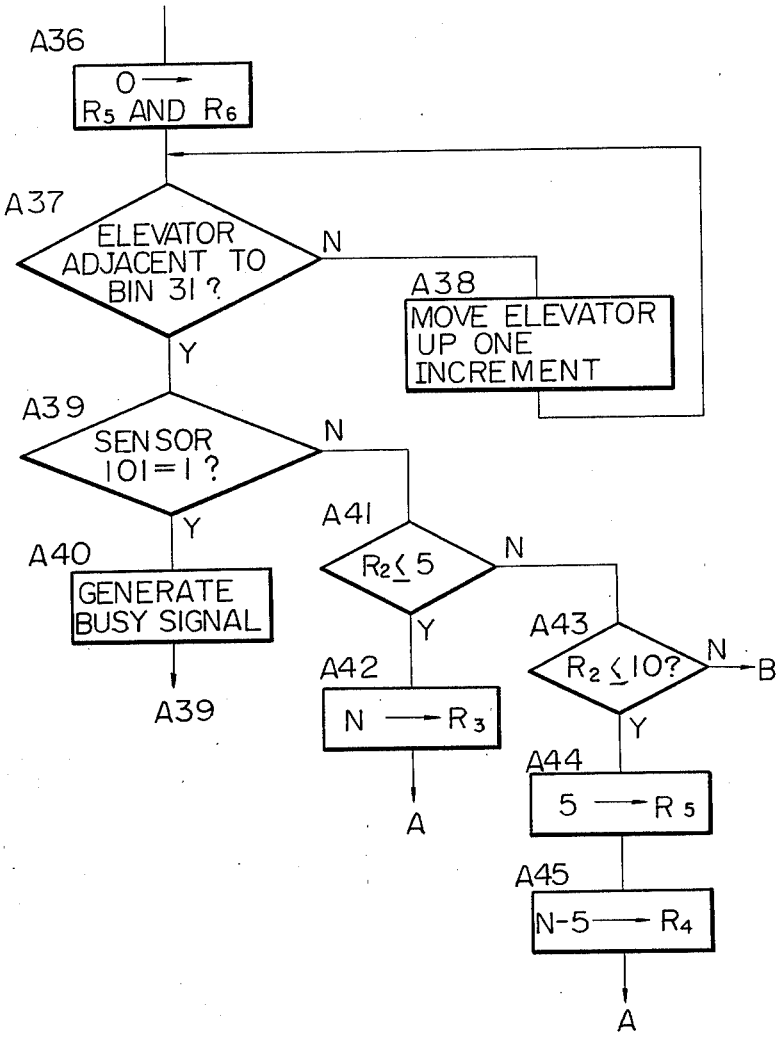

Referring also to FIG. 4, a microcomputer 103 is provided to perform computations and control operations of the apparatus 21 and also a copying machine or printing machine which produces the copies which are fed to the apparatus 21 through a control unit 104. The computer 103 comprises a central control unit (CPU) 106, a read only memory (ROM) 107 containing an operating program and a random access memory 108 for storing variables and intermediate results. The computer 103 also comprises storage registers R1 to R6.

The sensors 78, 79, 81, 101 and 102 are connected to the computer 103 by input-output interfaces (I/O) 109, 111, 112, 113 and 114 respectively. The computer 103 controls the stepping motor 97 through an input-output interface 116.

The operation of the apparatus 21 will now be described with reference being made to the flowcharts of FIGS. 5 to 8.

Assuming the collation mode, the number of pages in an original document for which a plurality of copies is to be made is designated as P. The number of copies to be made is designated as N. In other words, N copies of the original document or manuscript are to be made, with each copy containing P pages. Each of the N copies is to be distributed into a separate bin 31 to 40 respectively.

In step A1, the copying machine or printing machine feeds signals to the apparatus 21 indicating the number of copies N and number of pages of each copy P and also a signal indicating that the production and feeding of the copies is to begin. In step A2, the sensor 81 is checked to determine if the elevator 61 is adjacent to the upper or first bin 31. If not, the elevator 61 is moved upwardly by one increment (distance between adjacent bins) in step A3. The operation loops back to step A2 until the elevator 61 is adjacent to the bin 31.

In step A4, the sensors 101 and 102 are checked to see if there are sheets in the bins 31 and 36. This generally indicates the presence of sheets in all of the bins 31 to 40. The sensors 101 and 102 will produce a logical 1 signal if a sheet is present and a logical 0 signal if a sheet is not present, in the same manner as the sensors 78, 79 and 81. If a sheet is sensed, a busy signal is generated in step A5 to instruct the operator to remove the sheets. The operation loops back to step A4 until the sheets have been removed.

In accordance with an important feature of the present invention, when the number of copies to be collated (N) is less than or equal to the number of bins 31 to 40 (in this case 10), the copies are collated or distributed into the bins in a conventional manner. However, if the number of copies is greater than the number of bins, the bins 31 to 40 are divided into an upper group or block containing the bins 31 to 35 and a lower group or block containing the bins 36 to 40. Sheets are collated into the 5 bins 31 to 35 of the upper block and then collated into the 5 bins 36 to 40 of the lower block. This gives the operator a chance to remove the collated copies from the upper block while the sheets are being collated into the lower block and vice-versa. The apparatus 21 is also operable in the sorting mode in which a plurality of copies of each page is sorted into a separate bin 31 to 40. In this case, the elevator 61 is moved down by one bin each time the required number of copies have been sorted into a bin. The groups are used alternately as in the collation operation. A set of sheets or copies is defined to constitute the number N of bins required for the distribution operation. The number of bins 31 to 40 is illustrated and described as being 10. However, any number of bins may be provided such as 20, in which case the bins would be divided into upper and lower groups of 10 bins each.

After the bins 31 to 40 have been emptied as determined in step A4, the number of pages P and the number of copies N are set into the registers R1 and R2 in steps A6 and A7 respectively. In step A8, it is computed whether the number of copies N is greater than the number of bins (10). If N is smaller than or equal to 10, the number of copies N is set into the register R3 and zero is set into the register R4 in step A9. If the number of copies N is greater than 10, the number 5 is set into the register R3 in step A10 and the number 5 is set into the register R4 in step A11. After completion of these operations, a start signal is fed to the copying machine in step A12.

Steps A13, A14 and A15 constitute a jam sensing operation. If the sheet feed operation is normal, a time required for the leading edge of the sheet 67 to move from the sensor 78 to the sensor 79 will be equal to T1 which is the length of the sheet feed path from the sensor 78 to the sensor 79 divided by the feed speed. If the sensor 79 does not sense the leading edge of the sheet 67 within a time slightly greater than T1, it means that the sheet 67 jammed or failed to be fed for some other reason. Step A15 constitutes a timing operation to determine if the time elapsed between sensing of the leading edge of the sheet 67 by the sensor 78 and sensing of the leading edge of the sheet 67 by the sensor 79 exceeds the time T1. If so, a jam alarm is generated. If not, the operation proceeds to step A16.

In step A16, the sensor 101 will produce a 1 output each time a sheet is fed into the bin 31. If the output is 0, indicating that the sheet was fed into a bin other than 31, the operation branches to step A18. If the output of the sensor 101 is 1, the register R5, which was initially reset to zero, is incremented. Thus, the register R5 constitutes a page counter for the upper group of bins.

Steps A18 and A19 serve to determine whether the trailing edge of the sheet 67 moved past the sensor 79 into the designated bin. A predetermined time T2 is required for the trailing edge of the sheet 67 to pass the sensor 79 after the leading edge of the sheet 67 moves past the sensor 79. The time T2 is equal to the length of the sheet 67 divided by the feed speed. A jam alarm is generated if the time T2 is exceeded.

In step A20, the register R3 is decremented. The register R3 indicates the number of copies to be distributed into the upper group of bins when the number of remaining copies exceeds 10 and the number of copies to be distributed into both groups of bins when the remaining number of copies is less than 10. Thus, R3 is decremented each time a copy is distributed in the above manner. In step A21 it is determined if the register R3 has been decremented to zero, which would indicate that the distribution operation using at least the upper group of bins is completed. If R3 is not zero, the elevator 61 is moved down to the next bin in step 22 and a ready signal is fed to the copying machine in step A23 indicating that the apparatus 21 is ready to receive another sheet or copy. The operation then loops back to step A13.

On the other hand, if R3 has been decremented to zero, step A24 determines whether R5 has been incremented to equal the contents of R1 which is the number of pages P.

If the decision in step A24 is yes, the operation proceeds to step A24 in which it determined whether the contents of register R4 are zero. This would indicate that the distribution operation has been completed since it is no longer necessary to use the lower group of bins. It will be understood that a yes decision in step A24 indicates that copies of P pages have been collated.

If R5 does not equal R1 in step A24, the operation proceeds to steps A25, A26 and A27 which constitute a loop to move the elevator 61 upwardly to be adjacent to the bin 31. Upon completion of this operation, a ready signal is generated and N or 5 is set into register R3 in step A28 followed by a loop back to step A13.

If R4 is not zero, indicating that the collation operation is to be continued using the lower group of bins, the program branches to step A31 in which the sensor 102 is checked to determine if there are sheets or copies in the upper bin 36 of the lower group. If not, the operation continues to step A33. If so, a busy signal is generated in step A32 and the operation loops back to step A31 until the operator removes the sheets.

Steps A1 to A12 function to determine if the number of copies N to be collated exceeds the number of bins which is 10. If not, the copies are collated using all of the bins. If so, sets of copies or sheets are collated into the bins 31 to 35 and then sets of copies are collated into the bins 36 to 40. This enables the operator to remove the sheets from the upper group of bins while more sheets are being distributed into the lower group of bins without interrupting the operation of the copying machine.

Steps A13 to A32 function to perform the operation of collating or distributing N sets of copies each containing P pages into N respective bins starting with 31 when N is less than 10. The operation of steps A13 to A32 where N is greater than 10 consists of collating 5 sets of copies each containing P pages into the bins 31 to 35.

After obtaining a no decision in step A31 the operation proceeds to step A33 which consists of moving the elevator 61 down one increment to be adjacent to the first bin 36 of the lower group. In step A34, a lower group busy signal is generated to instruct the operator to remove the collated copies or sheets from the upper group. Steps A13', A14' and A15' constitute a jam sensing operation. Step A15' constitutes a timing operation to determine if the time elapsed between sensing of the leading edge of the sheet 67 by the sensor 78 and sensing of the leading edge of the sheet 67 by the sensor 79 exceeds the time T1. If so, a jam alarm is generated. If not, the operation proceeds to step A16'.

In step A16', the sensor 102 will produce a 1 output each time a sheet is fed into the bin 36. If the output is 0, indicating that the sheet was fed into a bin other than 36, the operation branches to step A18'. If the output of the sensor 102 is 1, the register R6, which was initially reset to zero, is incremented. Thus, the register R6 constitutes a page counter for the lower group of bins.

Steps A18' and A19' serve to determine whether the trailing edge of the sheet 67 moved past the sensor 79 into the designated bin. A jam alarm is generated if the time T2 is exceeded.

In step A20', the register R4 is decremented. The register R4 indicates the remaining number of copies to be distributed into the lower group of bins. Thus, R4 is decremented each time a copy is distributed in the above manner. In step A21' it is determined if the register R4 has been decremented to zero, which would indicate that the distribution operation using the lower group of bins is completed. If R4 is not zero, the elevator 61 is moved down to the next bin in step A22' and a ready signal is fed to the copying machine in step A23' indicating that the apparatus 21 is ready to receive another sheet or copy. The operation then loops back to step A13'.

On the other hand, if R4 has been decremented to zero, step A24' determines whether R6 has been incremented to equal the contents of R1 which is the number of pages P.

If the decision in step 24' is yes, the operation proceeds to step A35. This indicates that the distribution operation using the lower group of bins has been completed. It will be understood that a yes decision in step A24' indicates that copies of P pages have been collated.

If R6 does not equal R1 in step A24', the operation proceeds to step A26' to move the elevator 61 upwardly to be adjacent to the bin 36. Upon completion of this operation, a ready signal is generated in step A27' and 5 is set into register R4 in step A28' followed by a loop back to step A13'.

Steps A13' to A28' function to perform the operation of collating or distributing 5 sets of copies each containing P pages into the bins 36 to 40.

Upon completion of step A24', 10 sets of P pages each have been collated into the bins 31 to 40 respectively. The next step, A35, consists of subtracting 10 from the contents of register R2 to obtain a new number of copies N. Step A36 consists of resetting registers R5 and R6 to zero. Steps A37 and A38 constitute a loop for moving the elevator 61 upwardly adjacent to the bin 31.

In step A39, the sensor 101 is checked to see if sheets remain in the bin 31. If so, a busy signal is generated until the operator removes the sheets. When the sheets have been removed or the bin 31 emptied, the operation branches to step A41.

In step A41 it is determined or computed whether the remaining number of undistributed sets of copies N is less than the number of bins in the upper group, or 5. If yes, the operation proceeds to step A42 in which N is set into register R3 and the remaining copies collated into the bins of the upper group by branching back to step A12 as indicated at A. If the decision in step A41 is no, the operation branches to step A43 in which it is determined whether N is greater than the total number of bins, or 10. If N is less than or equal to 10, the program proceeds to step A44 in which 5 is set into register R3 and step A45 in which N-5 is set into register R4. After these operations are completed, the program branches back to step A12 as indicated at A. In this case, five sets of copies are collated into the upper group of bins and then the remaining sets of copies are collated into the lower group of bins. This allows the operator to remove the copies from the lower set of bins while the copies are being collated into the upper set of bins.

If N is greater than 10 in step A43, the program branches back to step A10 as indicated at B, causing the upper and groups of bins to be used alternately for collating the next 10 sets of copies.

Although the elevator 61 is moved downwardly adjacent to successive bins 31 to 40, it is within the scope of the present invention to move the elevator 61 upwardly and collate or sort using the lower group of bins followed by the upper group of bins.

Figure 9:
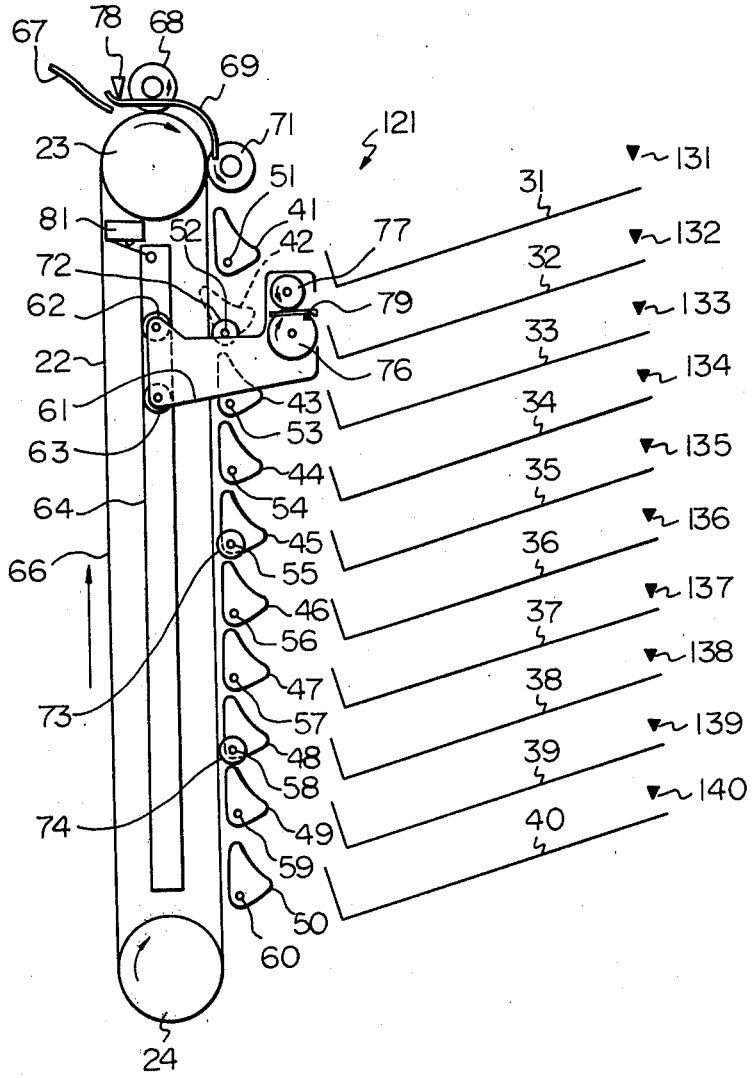
FIG. 9 is a schematic view of a second sheet distribution apparatus embodying the present invention.
Figure 10:
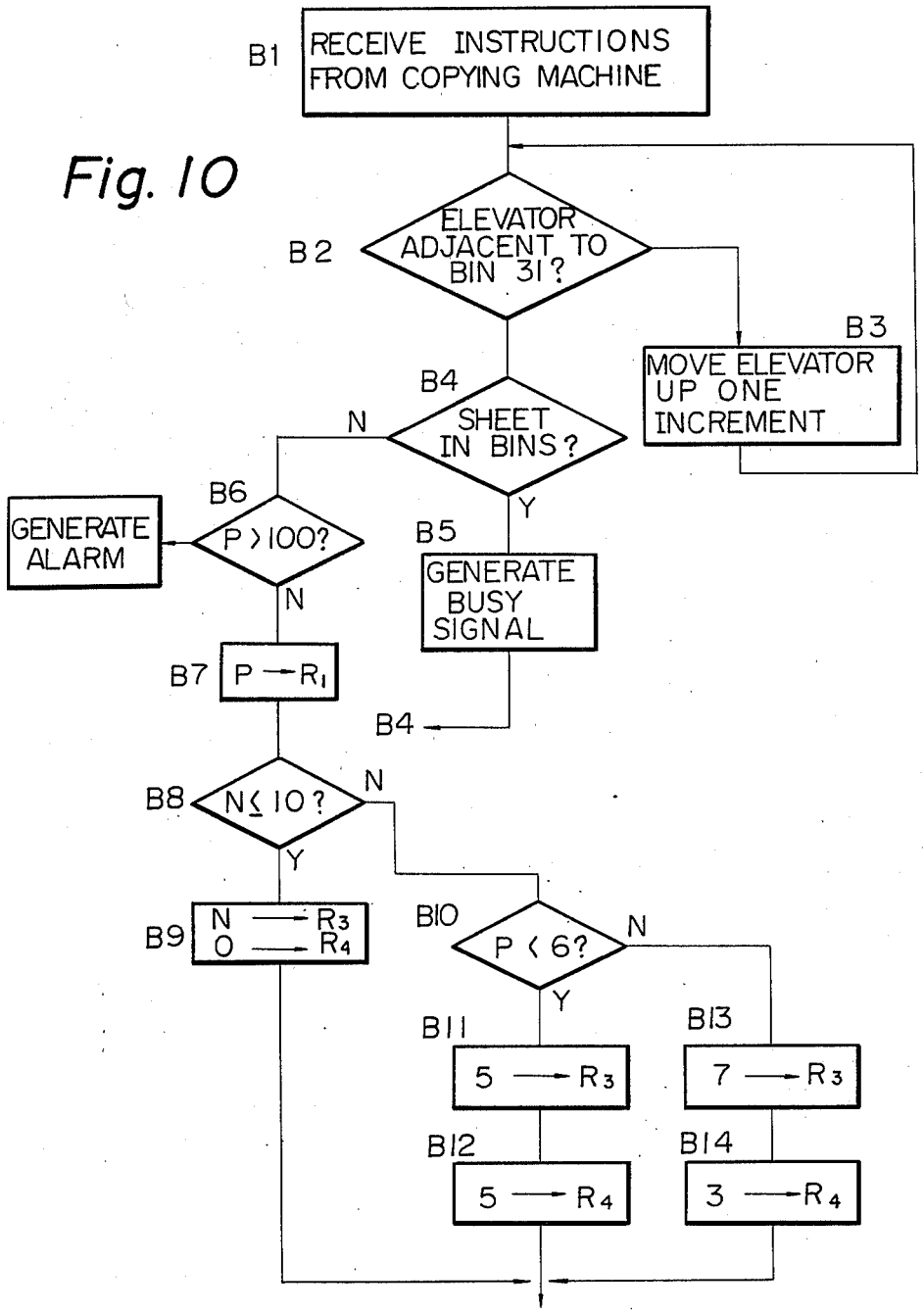
FIGS. 10, 11, 12 and 13 in combination constitute a flowchart of the operation of the apparatus of FIG. 9.
Figure 11:
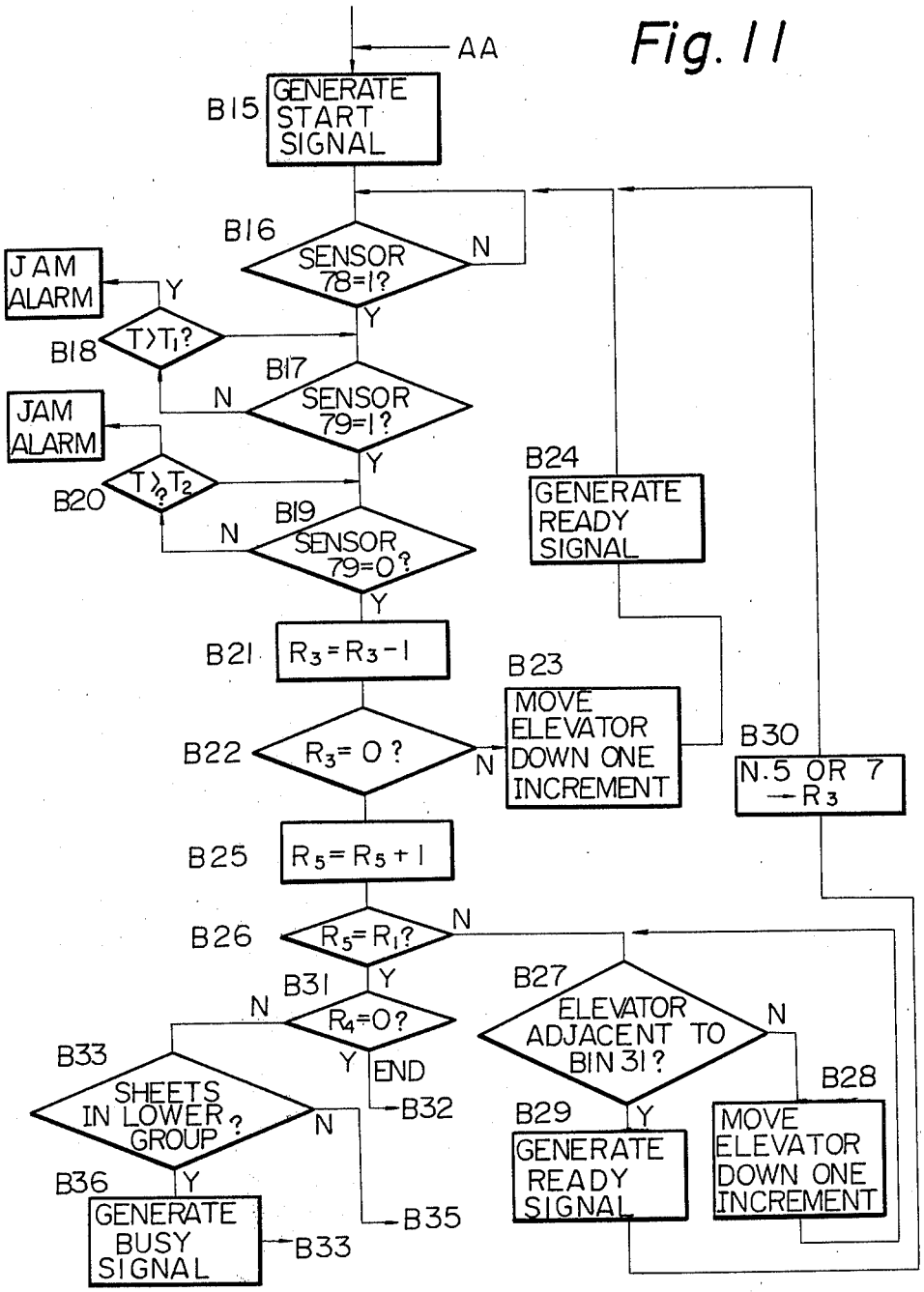
Figure 12:
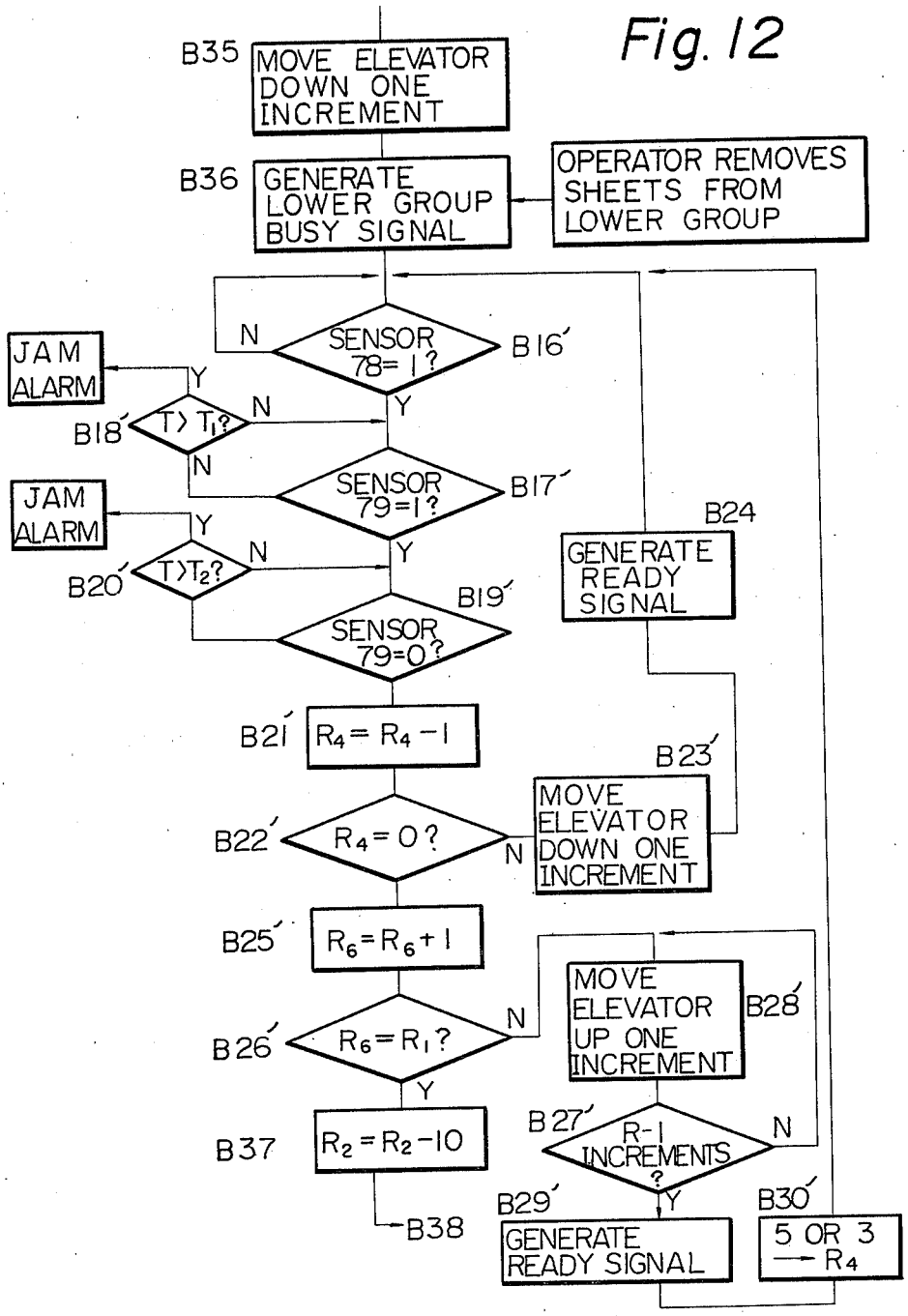
Figure 13:
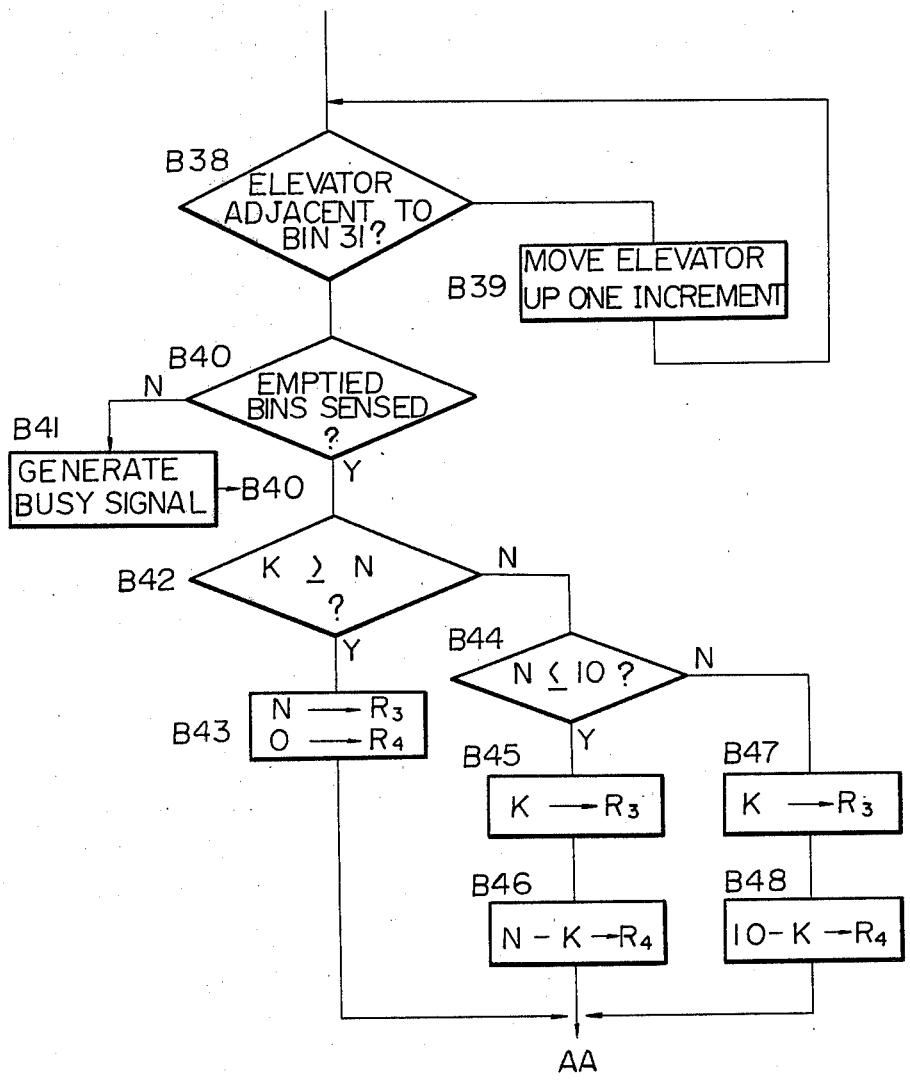

Another sheet distribution apparatus is shown in FIG. 9 and generally designated as 121. Like elements are designated by the same reference numerals used for the apparatus 21. The apparatus 121 differs from the apparatus 21 in that the sensors 101 and 102 are replaced by sensors 131 to 140 for individually sensing for the presence of sheets in the bins 31 to 40 respectively. The sensors 131 to 140 are individually scanned or checked by a microcomputer similar to the microcomputer 103 although not specifically illustrated.

The operation of the apparatus 121 will now be described with reference being made to the flowcharts of FIGS. 10 to 13.

The copying and sheet distributing time may be reduced by minimizing the number of times sheets or pages of original documents or manuscripts must be fed onto a platen of a copying machine, since these document feed operations take time. Assuming a case where there are 20 bins, if the bins are alternately used in upper and lower groups of 10 bins each and the number of pages P=6, 24 document feed operations would be required to produce 34 copies. In other words, each page of the document would be fed to the platen of the copying machine 4 times. However, if the upper group is defined to contain 14 bins and the lower group is defined to contain 6 bins, the 34 copies could be produced with only 18 document feed operations, since each page of the document would only have to be fed 3 times. Optimum efficiency would result when the upper group contains 19 bins and the lower group contains one bin. The time saving increases as the number of pages increases.

However, if the lower group contains only one bin and the number of pages P is small, for example 5 or less, the operator would not have enough time to remove the collated copies from the upper group of 19 bins while copies were being collated into the single bin of the lower group. Thus, some provision must be made to compensate for the various conflicting requirements.

In accordance with the present invention, when the number of copies N exceeds the number of bins, the number of pages P is considered. If P is greater than 5, the upper and lower groups are defined to contain 14 bins and 6 bins respectively where the number of bins is 20. If P is equal to or less than 5, the upper and lower groups are defined to contain 10 bins each. This gives the operator sufficient time to remove the copies from the upper group under all circumstances and extra time to remove the copies from the upper group when the number of pages P is small.

In FIG. 9 only 10 bins 31 to 40 are illustrated. Thus, for purposes of description of the important principles of the present invention, it will be assumed that when the number of copies N is greater than 10, the bins will be divided into a 7:3 ratio when the number of pages P is more than 5 and into a 5:5 ratio when the number of pages P is 5 or less.

After the first operation using the 10 bins is completed, the sensors 131 to 140 sense how many bins have been emptied starting from the first bin 31. Then the upper group is defined to comprise the emptied bins and the lower group is defined to contain the unemptied bins and collation performed using the upper group and then the lower group. However, if remaining number of undistributed copies (N-10) is less than the number of emptied bins, designated as K, the collation will be performed using only the emptied bins.

Referring now to FIGS. 10 to 13, step B1 consists of receiving the collation instructions and the variables P and N from the copying machine. Steps B2 and B3 constitute a loop to raise the elevator 61 to the home position adjacent to the bins 31. In step B4, the sensors 131 to 140 are scanned or checked to see if any sheets remain in any of the bins 31 to 40 respectively. If so, a busy signal is generated in step B5 and the program loops back to step B4 until the bins 31 to 40 have been emptied. When the bins have been emptied, the operation proceeds to step B6 in which it is determined whether the number of pages P is greater than the bin capacity of the apparatus 121, which is 100 sheets per bin. If P is greater than 100 an alarm is generated. The operation may be performed in two or more stages or performed using an additional apparatus 121 connected in series.

Assuming that P is less than 100, the operation proceeds to step B7 in which P is set into the register R1. In step B8, it is determined if N is less than the number of bins, which is 10. If N is less than 10, the operation proceeds to step B9 in which N is set into the register R3 and 0 is set into the register R4.

If N is greater than 10, the next step B10 is performed in which it is computed whether P is less than 6. If P is less than 6, 5 is set into the register R3 in step B11 and 5 is set into the register R4 in step B12. If P is equal to or greater than 6, 7 is set into the register R3 in step B13 and 3 is set into the register R4 in step B14. Then, the start signal is fed to the copying machine in step B15.

In step B16 the sensor 78 is checked to determine when the leading edge of the sheet reaches the sensor 78. Steps B17 and B18 constitute a loop to determine whether the leading edge of the sheet reaches the sensor 79 within the time T1. If not, an alarm is generated. If so, the operation proceeds to steps B19 and B20 which constitute a loop to determine whether the trailing edge of the sheet reaches the sensor 79 within the time T2 after the leading edge of the sheet reaches the sensor 79. If not, the jam alarm is generated. If so, it indicates that the sheet was safely discharged into the bin (did not jam in the elevator 61) and the operation proceeds to step 21.

In step 21, the register R3 is decremented since a copy has been produced. The contents of the register R3 are tested in step B22 to determine if the last copy of the upper group operation has been made. If not, the elevator 61 is moved down to the next bin in step B23 and the ready signal generated in step 24 after which the program loops back to step B16.

If R3 is zero, the operation proceeds to step B25 in which the upper group page counter register R5 is incremented. The register R5 was initially reset to zero and indicates the number of pages copied. In step B26, it is determined whether R5 has been incremented to the total number of pages P which is stored in the register R1. If not, indicating that some pages still remain uncopied, the program proceeds to steps B27 and B28 which constitute a loop to raise the elevator 61 to the home position adjacent to the bin 31. In step B29, the ready signal is generated whereas in step B30 either N, 5 to 7 is set into the register R3 in accordance with the results of steps B8 and B10 and the program loops back to step B16.

When R5=R1, the program proceeds to step B31 in which it is determined whether the contents of the register R4 are zero. If so, it indicates that the sheet distribution operation is completed and terminates at step B32. If R4 is not zero, the program proceeds to step B33 in which the sensors 131 to 140 are scanned to determine if there are any sheets in the lower group. It will be recalled that the lower group will contain the bins 38, 39 and 40 when P is greater than 5 and the bins 36, 37, 38, 39 and 40 when P is 5 or less.

If there are sheets in the lower group the program loops through step B36 back to step B33 to generate the busy signal until the operator removes the sheets. When there are no sheets in the lower group the program proceeds to step B35 in which the elevator 61 is moved down to the first (upper) bin of the lower group. In step B36, a lower group busy signal is generated to instruct the operator to remove the collated copies from the upper group of bins.

In step B16′ the sensor 78 is checked to determine when the leading edge of the sheet reaches the sensor 78. Steps B17′ and B18′ constitute a loop to determine whether the leading edge of the sheet reaches the sensor 79 within the time T1. If not, an alarm is generated. If so, the operation proceeds to steps B19′ and B20′ which constitute a loop to determine whether the trailing edge of the sheet reaches the sensor 79 within the time T2 after the leading edge of the sheet reaches the sensor 79. If not, the jam alarm is generated. If so, it indicates that the sheet was safely discharged into the bin (did not jam in the elevator 61) and the operation proceeds to step B21′.

In step B21′, the register R4 is decremented since a copy has been produced. The contents of the register R4 are tested in step B22′ to determine if the last copy of the lower group operation has been made. If not, the elevator 61 is moved down to the next bin in step B23′ and the ready signal generated in step B24′ after which the program loops pack to step B16′.

If R4 is zero, the operation proceeds to step B25′ in which the lower group page couter register R6 is incremented. The register R6 was initially reset to zero and indicates the number of pages copied. In step B26′, it is determined whether R6 has been incremented to the total number of pages P which is stored in the register R1. If not, indicating that some pages still remain uncopied, the program proceeds to steps B27′ and B28′ which constitute a loop to raise the elevator 61 to the position adjacent to the upper bin of the lower group. In step B29′, the ready signal is generated whereas in step B30′, either 5 or 3 is set into the register R4 in accordance with the results of steps B8 and B10 and the program loops back to step B16′.

When the decision in step B26′, is yes, the program proceeds to step B37 in which the number 10 is subtracted from the contents of the register R2. This is because 10 copies have been produced and the number of copies or sets of sheets remaining to be distributed is ten less than previously.

Steps B38 and B39 constitute a loop to raise the elevator 61 to the home position adjacent to the bin 31. In step B40, the sensors 131 to 140 are scanned to determine whether any of the bins 31 to 40 have been emptied by the operator. If not, the program loops through step B41 and then back to step B40 to generate a busy signal until the operator empties at least the first bin 31. The illustrated operation applies to a case where the bins are used from top to bottom and the operator removes the collated copies from the top to the bottom bins. Of course, it is well within the scope of the present invention to reverse the operation.

When at least one empty bin has been sensed, step B42 determines whether the number of emptied bins, designated as K, is greater than or equal to the remaining number of copies or sets of sheets to be distributed, which is the new value of N. If yes, N is set into the register R3 and 0 is set into the register R4 in step B43 and the program loops back to step B15 as indicated at AA. If no, the program branches to step B44 in which it is determined whether N is equal to or less than 10. If yes, K is set into R3 and N-K is set into R4 in steps B45 and B46 respectively, after which the operation loops back to step B15. If the decision in step B44 is no, K is set into the register R3 in step B47 and 10-K is set into the register R4 in step B48 after which the operation branches back to step B15.

Step B42 determines whether the number of emptied bins is sufficient to accomodate the remaining copies. If yes, the copies are collated into the empty bins.

If not enough empty bins are available to accomodate the remaining copies or undistributed sets of sheets, step B44 determines whether the remaining number of copies exceeds the total number of bins. If no, the collating operation is carried out using the emptied bins and then using the unemptied bins. If the number of bins is less than the number of remaining copies, the emptied bins are used followed by the unemptied bins and then the program loops back to step B15 to collate the remaining copies.

It will be understood that the operation of FIGS. 10 to 13 is an improvement over the operation of FIGS. 5 to 8 since it enables an increase in the copying and distributing speed.

Figure 14:
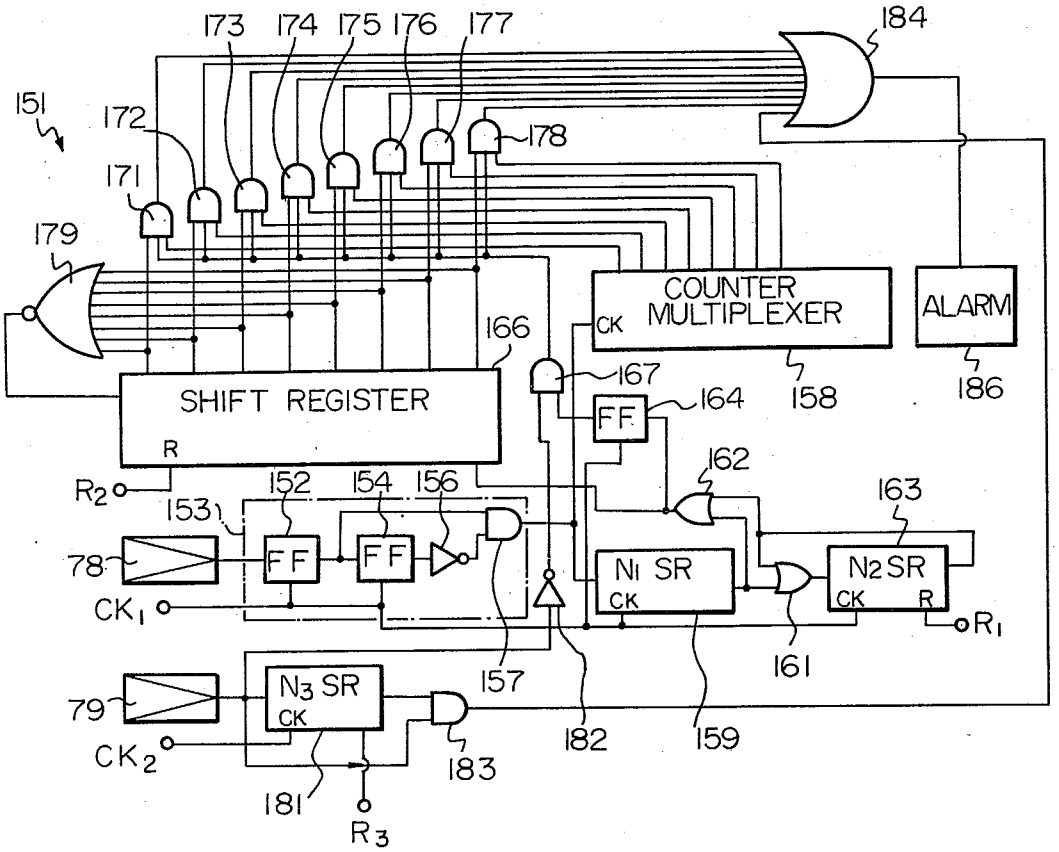
FIG. 14 is an electrical schematic diagram of a sensor means of the present invention.

A conventional collation or sorting apparatus requires a separate sensor provided to each bin to sense for jams or similar feed failures and complicated circuitry for scanning the sensors. This is overcome as illustrated in FIG. 14 in accordance with the present invention by a novel and unique sensor apparatus which is generally designated by the reference numeral 151 and comprises the sensors 78 and 79. It will be assumed that the apparatus 151 is designed to sense for sheet feed failures in a collator comprising eight bins such as a modification of the apparatus 21.

The output of the sensor 78 is connected to an input of a one-bit shift register or flip-flop 152 of a pulse generator unit 153. The output of the flip-flop 152 is connected to an input of a flip-flop 154, the output of which is connected to an input of an AND gate 157 through an inverter 156. The output of the flip-flop 152 is also connected to an input of the AND gate 157.

The output of the AND gate 157 is connected to a clock input of a modulo-8 counter-multiplexer 158 and to the data input of an n1 bit shift register 159. The output of the shift register 159 is connected to inputs of OR gates 161 and 162. The output of the OR gate 161 is connected to the data input of an n2 bit shift register 163, the output of which is connected to inputs of the OR gates 161 and 162. The output of the OR gate 162 is connected to the input of a flip-flop 164 and to a clock input of an 8-bit shift register 166. Clock pulses CK1 are applied to clock inputs of the flip-flops 152, 154 and 164 as well as to clock inputs of the shift registers 159 and 163. The output of the flip-flop 164 is connected to an input of an AND gate 167, the output of which is connected to inputs of AND gates 171 to 178. The counter-multiplexer 158 has outputs connected to inputs of the AND gates 171 to 178 respectively. The shift register 166 has parallel outputs which are connected to inputs of the AND gates 171 to 178 respectively. All of the outputs of the shift register 166 are connected to inputs of a NOR gate 179, the output of which is connected to the input of the shift register 166.

The output of the sensor 79 is connected to the input of an n3 bit shift register 181 and through an inverter 182 to an input of the AND gate 167. Clock pulses CK2 are applied to the clock input of the shift register 181. The output of the sensor 79 and the shift register 181 are connected to inputs of an AND gate 183, the output of which is connected to an input of an OR gate 184. Outputs of all of the AND gates 171 to 178 are connected to inputs of the OR gate 184. The output of the OR gate 184 is connected to an alarm 186. Reset pulses R1, R2 and R3 are applied to reset inputs of the shift registers 163, 166 and 181 respectively.

In operation, the shift registers 163, 166 and 181 are initially reset or cleared and the elevator 61 is moved adjacent to the first bin 31 of the apparatus 21. The counter-multiplexer 158 is preset to the maximum count of eight. The stages of the shift register 166 produce logically low or zero outputs so that the NOR gate 179 produces a high output. The low outputs of the shift register 166 inhibit all of the AND gates 171 to 178 so that they and also the OR gate 184 produce low outputs.

When the leading edge of the first sheet reaches the sensor 78, the output of the sensor 78 goes high and the output of the flip-flop 152 goes high in response to the leading edge of the next clock pulse CK1. At this point the output of the flip-flop 152 is high and the output of the flip-flop 154 is low so that the AND gate 157 produces a high output. In response to the next clock pulse CK1 the output of the flip-flop 152 remains high but the output of the flip-flop 154 goes high to inhibit the AND gate 157 through the inverter 156. As the result of these operations the output of the AND gate 157 which constitutes the output of the pulse generator 153 goes high for the duration of the first clock pulse CK1 generated after the leading edge of the first sheet is sensed by the sensor 78. The outputs of the flip-flops 152 and 154 go sequentially low as the trailing edge of the sheet passes the sensor 78 so that the output of the AND gate 157 remains low. Thus, the pulse generator 153 produces one pulse in response to sensing the leading edge of a sheet.

The pulse output of the generator 153 is applied to the counter-multiplexer 158 which overflows to zero and feeds a high output to the AND gate 171. However, the output of the AND gate 171 remains low due to the low inputs from the AND gate 167 and shift register 166. The pulse from the generator 153 is applied to the shift register 159 and shifted therethrough in response to the clock pulses CK1.

The number of bits n1 of the shift register 159 is selected in accordance with the following relation $$(n1+1)\cdot t1>Ta \ldots \quad (1)$$

where t1 is the repetition frequency of the clock pulses CK1 and Ta is the time required for the leading edge of a sheet to move from the sensor 78 to the sensor 79 with the elevator 61 adjacent to the upper bin 31. In other words, the pulse from the generator 153 will be shifted out of the shift register 159 after a time T1 slightly greater than time required for the leading edge of a sheet to move from the sensor 78 to the sensor 79. The high output of the shift register 159 is gated through the OR gate 162 to the flip-flop 164 and the shift register 166. In response, the shift register 166 shifts the high output of the NOR gate 179 into the first stage of the shift register 166 after which time the shift register 166 feeds a high output to the AND gate 171. This output is also applied to the NOR gate 179 which produces a low output. The initial high output of the NOR gate 179 is shifted through the shift register 166 in response to high outputs from the OR gate 162 to sequentially apply high outputs to the AND gates 171 to 178.

Assuming that the leading edge of the sheet reaches the sensor 79 before the shift register 159 produces a high output, the output of the sensor 79 will go high and inhibit the AND gate 167 through the inverter 182. Thus, even though the AND gate 171 receives two high inputs from the counter-multiplexer 158 and shift register 166, it will not produce a high output since the output of the AND gate 167 is low.

However, if the sheet jams and does not reach the sensor 79 when the shift register 159 produces a high output, the high output of the flip-flop 164 which is set by the high output of the shift register 159 and the low output of the sensor 79 which is inverted by the inverter 182 cause the AND gate 167 to produce a high output. In this case, all three inputs to the AND gate 171 are high and the AND gate 171 produces a high output which is fed through OR gate 184 to activate the alarm 186.

The AND gates 171 to 178 correspond to the eight bins of the sheet distribution apparatus 21 from the upper or first bin to the lower to eighth bin respectively. A high output from the AND gate 171 indicates that the sheet jammed or otherwise failed to be fed between the sensors 78 and 79. In response to the alarm, the copying machine and sheet distribution apparatus are de-energized and the operator alerted to repair the malfunction.

Assuming that the leading edge of the sheet reached the sensor 79 in time, the output of the sensor 79 will go high and be shifted into the first stage of the shift register 181 in response to the next clock pulse CK2. At this time, the output of the shift register 181 will be low and the AND gate 183 will produce a low output.

The number of bits n3 of the shift register 181 is selected in accordance with the following relation $$T2=(n3+1)\cdot t2>Tc \ldots \quad (2)$$

where t2 is the repetition frequency of the clock pulses CK2 and Tc is the time required for the trailing edge of the sheet to move past the sensor 79 after the leading edge of the sheet moves past the sensor 79. Thus, the output of the shift register 181 will go high at the time T2 slightly longer than the time required for the sheet to clear the sensor 79.

Assuming that the trailing edge of the sheet clears the sensor 79 in time, the output of the sensor 79 will go low before the output of the shift register 183 goes high. Thus, the output of the AND gate 183 will remain low. However, if the sheet jams in the elevator 61, the output of the sensor 79 will remain low when the shift register 181 produces a high output. Thus, the AND gate 183 will produce a high output to energize the alarm 186 through the OR gate 184.

Although not shown, the shift registers 163, 166 and 181 are cleared or reset by the signals R1, R2 and R3 respectively in response to the output of the sensor 79 going low.

The elevator 61 is then moved downwardly adjacent the next bin 32 and the next sheet fed from the copying machine. The generator 153 produces an output pulse when the leading edge of the sheet is sensed by the sensor 78. This pulse increments the counter-multiplexer 158 which feeds a high output to the AND gate 172. The counter-multiplexer 158 is incremented each time the leading edge of a sheet is sensed to sequentially feed high signals to the AND gates 171 to 178 in response thereto.

The pulse from the generator 159 is shifted through the shift register 159 and fed out to the shift register 166 as described previously to cause the shift register 166 to feed a high output to the AND gate 171. Neither of the AND gates 171 and 172 will produce high outputs since they have only two high inputs from the shift register 166 and counter-multiplexer 158 respectively. The output of the sensor 79 will not go high when the output of the shift register 159 goes low since the leading edge of the sheet has not reached the sensor 79 even if the sheet feed is normal. This is due to the distance between the first and second bins 31 and 32 which increases the feed time. However, the outputs of the AND gates 171 and 172 will remain low even though the output of the AND gate 167 goes high since they will only have two high inputs.

The number of bits n2 of the shift register 163 is selected as follows $$(n2+1)\cdot t1>(Tb-Ta) \ldots \quad (3)$$

where Tb is the time required for the leading edge of the sheet to move from the sensor 78 to the sensor 79 when the elevator 61 is adjacent to the second bin 32. The difference Tb-Ta is the additional time required for the sheet feed to the second bin 32 due to the increased length of the sheet feed path. The difference Tb−Ta is constant between adjacent bins since the distance between adjacent bins is constant. Thus, the feed time for the first bin 31 is Ta. The feed time for the second bin 32 is Tb or $Ta+(1\times(Tb-Ta))$. The feed time for the third bin 33 is $Ta+(2\times(Tb-Ta))$, etc. Generally, the following relation holds for the time required for feeding the leading edge of the sheet from the sensor 78 to the sensor 79

$$Ta+(M\times(TB-Ta)) \ldots \quad (4)$$

where M is a multiple equal to the number of bins counted from the bin to which the elevator 61 is adjacent to the first bin 31. The multiple M is 0 for the first bin 31, 1 for the second bin 32, 2 for the third bin 33, etc. The shift register 163 provides the time Tb−Ta whereas the shift register 159 provides the time Ta. The shift register 166 in combination with the counter-multiplexer 158 provide the multiple M as will become clear from further description.

The shift register 159 will produce a high output at the time T1 slightly greater than Ta after the leading edge of the second sheet reaches the sensor 78 causing the shift register 166 to apply a high output to the AND gate 171. However, it will be recalled that the AND gate 172 for the second bin 32 receives a high output from the counter-multiplexer 158. The output of the shift register 159 constitutes a first clock pulse for the shift register 166. The shift register 163 will produce a high signal after the time $Ta+(1\times(Tb-Ta))$ which is fed to the shift register 166 as a second clock pulse. In response, the shift register 166 will feed a high output to the AND gate 172. The flip-flop 164 is also set by the high output of the shift register 163. Thus, if the leading edge of the sheet reaches the sensor 79 properly, the AND gate 167 will be inhibited as before and vice-versa.

The third pulse output of the generator 153 for the third sheet increments the counter-multiplexer 158 which feeds a high output to the AND gate 173. The first output of the shift register 163 constitutes a second clock pulse for the shift register 166 which feeds a high output to the AND gate 172. The high output of the shift register 163 is recirculated through the OR gate 161 to the input thereof. In this manner, the shift register 163 will produce high outputs at multiples slightly greater than $Tb-Ta$. The second output of the shift register 163 constitutes a third clock pulse for the shift register 166 which feeds a high output to the AND gate 173 in response thereto. The AND gate 173 now has two high inputs and will produce a high output if the sensor 79 remains low indicating a feed failure. This operation is continued for the remaining bins.

Figure 15:
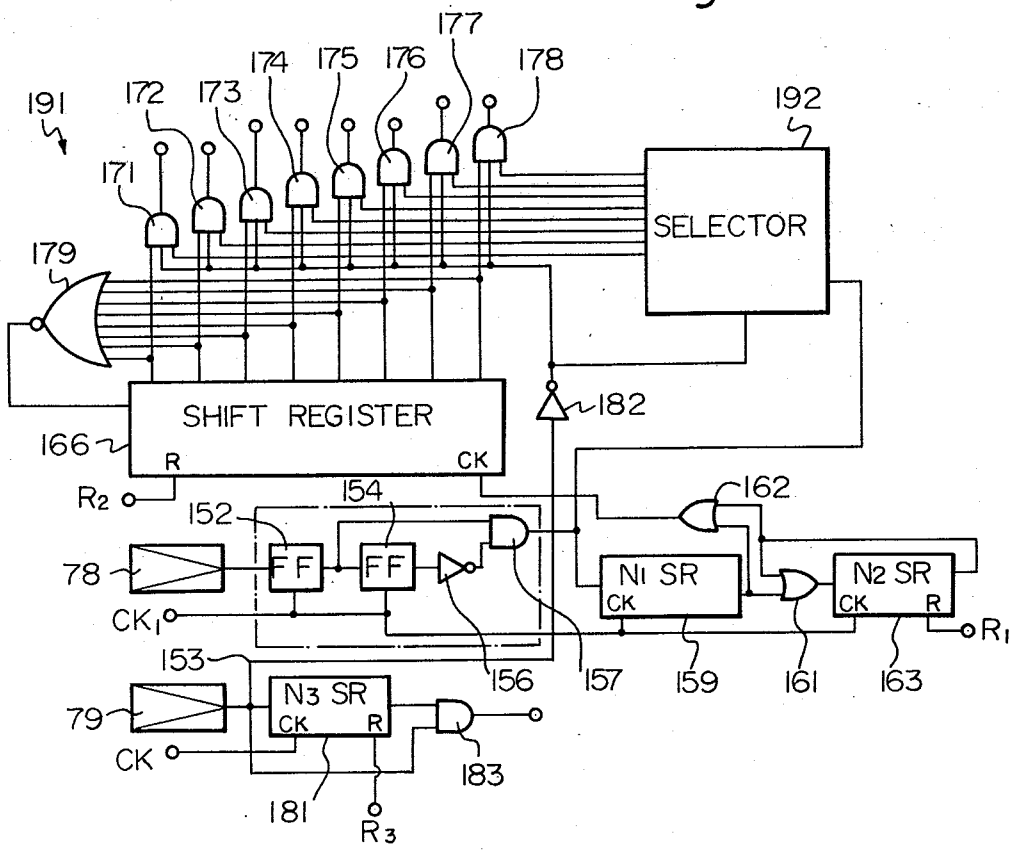
FIG. 15 is similar to FIG. 14 but illustrates another sensor means.

Whereas the apparatus 151 operates in the collation mode, an apparatus 191 illustrated in FIG. 15 operates in the sorting mode. The counter-multiplexer 158 is replaced with a selector 192. Although not shown in detail, the selector 192 comprises frequency dividers to frequency divide the outputs of the pulse generator 153 and inverter 182 by a ratio equal to the number of sheets to be distributed into each bin prior to moving the elevator downwardly to the next bin. Preferably, the frequency division ratio is variable to accomodate various numbers of sheets.

The frequency divided output of the inverted 182 causes the selector 192 to sequentially feed high outputs to the AND gates 171 to 178 to select the bins. The output of the inverter 182 goes high when a sheet clears the sensor 79 and is also used to cause the stepping motor 97 to move the elevator 61 down to the next bin.

Preferably, the apparatus 151 and 191 are combined using common components to enable operation in either the collation mode or sorting mode.

In summary, it will be seen that the present invention overcomes the drawbacks of the prior art and provides a sheet distribution method and apparatus which operate at increased speed using a simplified arrangement compared to the prior art. Various modifications will become possible for those skilled in the art after receiving the teachings of the present disclosure without departing from the scope thereof.

What is claimed is:

1. A sheet distribution apparatus including a predetermined number of bins and distribution means for selectively distributing sheets into the bins, characterized by comprising:

first sensor means for sensing presence of a sheet at an inlet of the distribution means;

second sensor means for sensing presence of the sheet at an outlet of the distribution means; and timing means responsive to the first and second sensor means for generating an alarm at a first predetermined time after the first sensor means senses the presence of the sheet unless the second sensor means senses presence of the sheet within the first predetermined time;

the first and second sensor means being constructed to produce first and second signals respectively in response to sensing of a leading edge of the sheet, the timing means generating the alarm unless the second signal is generated within the first predetermined time after the first signal is generated;

the distribution means comprising a fixed inlet means and an outlet means which is movable relative to the bins, the first and second sensor means being disposed adjacent to the inlet and outlet means respectively;

the timing means being responsive to a position of the outlet means and constructed to compute the first predetermined time as a function thereof, the first predetermined time being slightly greater than a time required for the leading edge of the sheet to be fed from the first sensor means to the second sensor means.

2. An apparatus as in claim 1, in which the second sensor means is further constructed to produce a third signal in response to sensing a trailing edge of the sheet, the timing means being further constructed to generate the alarm unless the third signal is generated within a second predetermined time after the second signal is generated.

3. An apparatus as in claim 1, in which the distribution means comprises means for moving the outlet means sequentially relative to the bins from a first bin to a last bin, the timing means being constructed to compute the first predetermined time as being slightly greater than a second predetermined time which is required for the leading edge of the sheet to be fed from the first sensor means to the second sensor means when the outlet means is adjacent to the first bin plus a multiple of a third predetermined time, the multiple being equal to a number of bins from the first bin to a bin to which the outlet means is adjacent, the third predetermined time being equal to a difference between a time required for the leading edge of the sheet to be fed from the first sensor means to the second sensor means when the outlet means is adjacent to a second bin and the second predetermined time.

4. An apparatus as in claim 1, further comprising control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins.

5. An apparatus as in claim 4, in which the control means is further constructed to, when the number of sets of sheets is equal to or smaller than the number of bins, distribute the sets of sheets into the bins.

6. An apparatus as in claim 4, further comprising third sensor means for sensing a number of emptied bins, the computing means being further constructed to compute whether a number of undistributed sets of sheets is greater than the number of emptied bins, the control means, when the number of undistributed sets of sheets is greater than the number of emptied bins, dividing the bins into third and fourth groups constituted by the emptied bins and unemptied bins respectively, distributing sets of sheets into the third group of bins, sensing when the fourth group of bins has been emptied and controlling the distribution means to distribute sets of sheets into the fourth group of bins when the fourth group of bins has been emptied.

7. An apparatus as in claim 6, in which the control means is further constructed, when the number of undistributed sheets is equal to or smaller than the number of emptied bins, to distribute the sets into the emptied bins.

8. An apparatus as in claim 4, in which the control means is constructed to divide the bins into the first group and the second group in such a manner that the first group contains more bins than the second group.

9. An apparatus as in claim 4, in which the computing means is further constructed to compute whether a number of sheets in each set is greater than a predetermined number, the control means, when the number of sheets is greater than the predetermined number, dividing the bins into the first and second groups in such a manner that the first group contains more bins than the second group.

10. An apparatus as in claim 9, in which the control means is further constructed to, when the number of sheets is smaller than or equal to the predetermined number, divide the bins into the first and second groups in such a manner that the first and second groups contain the same number of bins.

11. An apparatus as in claim 4, in which the computing means is constructed to, after the distribution means distributes sets of sheets into the first and second groups, compute whether a number of undistributed sets of sheets is greater than the number of bins, the control means, when the number of undistributed sets of sheets is greater than the number of bins, dividing the bins into the first and second groups and controlling the distribution means to distribute sets of sheets into the first group of bins and then distribute sets of sheets into the second group of bins.

12. An apparatus as in claim 11, in which the control means is constructed to, after the distribution means distributes sets of sheets into the first and second groups, sense when the first group of bins has been emptied and control the distribution means to distribute sets of sheets into the first group of bins when the first group of bins has been emptied and sensing when the second group of bins has been emptied and control the distribution means to distribute sets of sheets into the second group of bins when the second group of bins has been emptied.

13. An apparatus as in claim 1, in which the control means is constructed to, when the number of undistributed sets of sheets is equal to or smaller than the number of bins, control the distribution means to distribute sets of sheets into the bins.

14. An apparatus as in claim 13, in which the control means is further constructed to sense when the bins have been emptied and control the distribution means to distribute sets of sheets into the bins when the bins have been emptied.

15. A sheet distribution apparatus including a predetermined number of bins and distribution means for selectively distributing sheets into the bins, characterized by comprising:

control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the control means being further constructed to, when the number of sets of sheets is equal to or smaller than the number of bins, distribute the sets of sheets into the bins using all of the bins as a single group;

the computing means being further constructed to compute whether a number of sheets in each set is greater than a predetermined number, the control means, when the number of sheets is greater than the predetermined number, dividing the bins into the first and second groups in such a manner that the first group contains more bins than the second group.

16. An apparatus as in claim 15, in which the control means is further constructed to, when the number of sheets is smaller than or equal to the predetermined number, divide the bins into the first and second groups in such a manner that the first and second groups contain the same number of bins.

17. A sheet distribution apparatus including a predetermined number of bins and distribution means for selectively distributing sheets into the bins, characterized by comprising:

control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the control means being further constructed to, when the number of sets of sheets is equal to or smaller than the number of bins, distribute the sets of sheets into the bins using all of the bins as a single group;

the computing means being constructed to, after the distribution means distributes sets of sheets into the first and second groups, compute whether a number of undistributed sets of sheets is greater than the number of bins, the control means, when the number of undistributed sets of sheets is greater than the number of bins, dividing the bins into the first and second groups and controlling the distribution means to distribute sets of sheets into the first group of bins and then distribute sets of sheets into the second group of bins;

the control means being constructed to, after the distribution means distributes sets of sheets into the first and second groups, sense when the first group of bins has been emptied and control the distribution means to distribute sets of sheets into the first group of bins when the first group of bins has been emptied and sensing when the second group of bins has been emptied and control the distribution means to distribute sets of sheets into the second group of bins when the second group of bins has been emptied.

18. A sheet distribution method for distributing a plurality of sets of sheets into separate bins, comprising the steps of:

(a) providing a predetermined number of bins and distribution means for selectively distributing the sheets to the bins;

(b) computing whether a number of the sets of sheets is greater than the number of bins; and (c) when the number of sets of sheets is greater than the number of bins, dividing the bins into first and second groups, distributing sets of sheets into the first group of bins and then distributing sets of sheets into the second group of bins;

the method further comprising the step, following step (b), of:

(i) computing whether a number of sheets in each set is greater than a predetermined number of sheets, step (c) comprising, when the number of sheets is greater than the predetermined number of sheets, dividing the bins into the first and second groups in such a manner that the first group contains more bins than the second group.

19. A method as in claim 18, in which step (c) comprises, when the number of sheets is smaller than or equal to the predetermined number of sheets, dividing the bins into the first and second groups in such a manner that the first and second groups contain equal numbers of bins.

20. A sheet distribution method for distributing a plurality of sets of sheets into separate bins, comprising the steps of:

(a) providing a predetermined number of bins and distribution means for selectively distributing the sheets to the bins;

(b) computing whether a number of the sets of sheets is greater than the number of bins; and (c) when the number of sets of sheets is greater than the number of bins, dividing the bins into first and second groups, distributing sets of sheets into the first group of bins and then distributing sets of sheets into the second group of bins;

the method further comprising the steps, following step (c), of:

(j) computing whether a number of undistributed sets of sheets is greater than the number of bins; and (k) when the number of undistributed sets of sheets is greater than the number of bins, dividing the bins into the first and second groups, distributing sets of sheets into the first group of bins and then distributing sets of sheets into the second group of bins;

step (k) comprising sensing when the first group of bins has been emptied and distributing sets of sheets into the first group of bins when the first group of bins has been emptied and sensing when the second group of bins has been emptied and distributing sets of sheets into the second group of bins when the second group of bins has been emptied.

21. A sheet distribution apparatus including a predetermined number of bins and distribution means for selectively distributing sheets into the bins, characterized by comprising:

first sensor means for sensing presence of a sheet at an inlet of the distribution means;

second sensor means for sensing presence of the sheet at an outlet of the distribution means;

timing means responsive to the first and second sensor means for generating an alarm at a first predetermined time after the first sensor means senses the presence of the sheet unless the second sensor means senses presence of the sheet within the first predetermined time; and control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the computing means being further constructed to compute whether a number of sheets in each set is greater than a predetermined number, the control means, when the number of sheets is greater than the predetermined number, dividing the bins into the first and second groups in such a manner that the first group contains more bins than the second group.

22. An apparatus as in claim 21, in which the control means is further constructed to, when the number of sheets is smaller than or equal to the predetermined number, divide the bins into the first and second groups in such a manner that the first and second groups contain the same number of bins.

23. A sheet distribution apparatus including a predetermined number of bins and distribution means for selectively distributing sheets into the bins, characterized by comprising:

first sensor means for sensing presence of a sheet at an inlet of the distribution means;

second sensor means for sensing presence of the sheet at an outlet of the distribution means;

timing means responsive to the first and second sensor means for generating an alarm at a first predetermined time after the first sensor means senses the presence of the sheet unless the second sensor means senses presence of the sheet within the first predetermined time; and control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the computing means being constructed to, after the distribution means distributes sets of sheets into the first and second groups, compute whether a number of undistributed sets of sheets is greater than the number of bins, the control means, when the number of undistributed sets of sheets is greater than the number of bins, dividing the bins into the first and second groups and controlling the distribution means to distribute sets of sheets into the first group of bins and then distribute sets of sheets into the second group of bins;

the control means being constructed to, after the distribution means distributes sets of sheets into the first and second groups, sense when the first group of bins has been emptied and control the distribution means to distribute sets of sheets into the first group of bins when the first group of bins has been emptied and sensing when the second group of bins has been emptied and control the distribution means to distribute sets of sheets into the second group of bins when the second group of bins has been emptied.

24. A sheet distribution apparatus including a predetermined number of bins and distribution means for selectively distributing sheets into the bins, characterized by comprising:

control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the computing means being further constructed to compute whether a number of sheets in each set is greater than a predetermined number, the control means, when the number of sheets is greater than the predetermined number, dividing the bins into the first and second groups in such a manner that the first group contains more bins than the second group.

25. An apparatus as in claim 24, in which the control means is further constructed to, when the number of sheets is smaller than or equal to the predetermined number, divide the bins into the first and second groups in such a manner that the first and second groups contain the same number of bins.

26. A sheet distribution apparatus including a predetermined number of bins and distribution means for selectively distributing sheets into the bins, characterized by comprising:

control means for controlling the distribution means to distribute a plurality of sets of sheets into respective bins and computing means for computing whether a number of the sets of sheets is greater than the number of bins, the control means, when the number of sets of sheets is greater than the number of bins, dividing the bins into first and second groups and controlling the distribution means to distribute sets of sheets into the first group of bins and then distribute sets of sheets into the second group of bins;

the computing means being constructed to, after the distribution means distributes sets of sheets into the first and second groups, compute whether a number of undistributed sets of sheets is greater than the number of bins, the control means, when the number of undistributed sets of sheets is greater than the number of bins, dividing the bins into the first and second groups and controlling the distribution means to distribute sets of sheets into the first group of bins and then distribute sets of sheets into the second group of bins;

the control means being constructed to, after the distribution means distributes sets of sheets into the first and second groups, sense when the first group of bins has been emptied and control the distribution means to distribute sets of sheets into the first group of bins when the first group of bins has been emptied and sensing when the second group of bins has been emptied and control the distribution means to distribute sets of sheets into the second group of bins when the second group of bins has been emptied.

* * * * *